US010703994B2

(12) United States Patent
Govindhakannan et al.

(10) Patent No.: US 10,703,994 B2
(45) Date of Patent: Jul. 7, 2020

(54) PROCESS AND APPARATUS FOR TWO-STAGE DEASPHALTING

(71) Applicant: UOP LLC, Des Plaines, IL (US)

(72) Inventors: Jagannathan Govindhakannan, Des Plaines, IL (US); Hans G. Lefebvre, Chicago, IL (US)

(73) Assignee: UOP LLC, Des Plaines, IL (US)

( * ) Notice: Subject to any disclaimer, the term of this patent is extended or adjusted under 35 U.S.C. 154(b) by 303 days.

(21) Appl. No.: 15/719,221

(22) Filed: Sep. 28, 2017

(65) Prior Publication Data

US 2019/0093025 A1 Mar. 28, 2019

(51) Int. Cl.
*C10G 53/06* (2006.01)
*C10G 21/00* (2006.01)

(52) U.S. Cl.
CPC ..... *C10G 53/06* (2013.01); *C10G 21/003* (2013.01); *C10G 2300/44* (2013.01)

(58) Field of Classification Search
None
See application file for complete search history.

(56) References Cited

U.S. PATENT DOCUMENTS

| | | | |
|---|---|---|---|
| 3,830,732 | A | 8/1974 | Gatsis |
| 4,572,781 | A | 2/1986 | Krasuk et al. |
| 4,810,367 | A | 3/1989 | Chombart et al. |
| 2016/0304793 | A1 | 10/2016 | Merdrignac et al. |

FOREIGN PATENT DOCUMENTS

WO 2016078994 A1 5/2016

OTHER PUBLICATIONS

U.S. EPA, Study of Selected Petroleum Refining Residuals, 1996, p. 120. (Year: 1996).*
Parkash, S. Refining Processes Handbook, 2003, Gulf Publishing, p. 200. (Year: 2003).*

* cited by examiner

*Primary Examiner* — Derek N Mueller
(74) *Attorney, Agent, or Firm* — Paschall & Associates, LLC; James C. Paschall

(57) ABSTRACT

Solvent deasphalting (SDA) in series is used to extract deasphalted oil from heavier hydrocarbons in series. Instead of stripping the pitch material of solvent in the second stage which can stick in the pitch stripper and inhibit flow, a dryer is used to vaporize solvent for recycle to the second SDA unit and produce pitch solids.

19 Claims, 1 Drawing Sheet

PROCESS AND APPARATUS FOR TWO-STAGE DEASPHALTING

FIELD

The field relates to a process and apparatus for separating heavy hydrocarbon feed by solvent deasphalting into a lighter hydrocarbon stream.

BACKGROUND

As the reserves of conventional crude oils decline, heavy oils must be upgraded to meet market demands. Crude oil is typically first processed in an atmospheric crude distillation tower to provide fuel products including naphtha, kerosene and diesel. The atmospheric crude distillation resid bottoms stream is typically taken to a vacuum distillation tower to obtain vacuum gas oil (VGO) that can be feedstock for an FCC unit or a hydrocracking unit and vacuum residue (VR).

Solvent deasphalting (SDA) generally refers to refinery processes that upgrade hydrocarbon fractions using extraction in the presence of a solvent. The hydrocarbon fractions are often obtained from the distillation of crude oil, and include hydrocarbon residues or resids or gas oils from atmospheric column or vacuum column distillation. SDA permits practical recovery of higher quality oil, at relatively low temperatures, without cracking or degradation of heavy hydrocarbons. SDA separates hydrocarbons according to their solubility in a liquid solvent, as opposed to volatility in distillation. Lower molecular weight and most aliphatic components are preferentially extracted. The least soluble materials are high molecular weight and mostly aromatic and polar components. This makes the deasphalted oil (DAO) extract light and aliphatic, and the asphaltic raffinate also known as pitch, heavy and aromatic. Suitable solvents for SDA include propane and higher molecular weight paraffins, such as butane and pentane, for example. The pitch stream generally contains metal compounds as well as high molecular weight hydrocarbons.

SDA typically recovers no more than about 40 wt % product. Hence, further recovery is very desirable in SDA to make it worthwhile. Solvent deasphalting in series has been proposed but not successfully commercialized. The second deasphalting column in the series receives a light pitch stream that has been stripped of solvent, typically. The light pitch stream extracted with a heavier solvent leaves very heavy asphaltenes in a heavy pitch stream. Once the heavy pitch stream is stripped to remove residual solvent, the heavy pitch stream is so viscous that it can set up in the heavy asphaltene stripper, making removal and transport prohibitive.

There is an ongoing need for two-stage deasphalting processes and apparatus to increase recovery of the lighter useable portion of the feed without making removal and transport of the heavy pitch stream difficult.

SUMMARY

We have discovered that two stage solvent deasphalting can be made practicable by processing the heavy pitch stream with a dryer to remove the solvent. The dryer may be an elongated vessel that moves the pitch stream longitudinally in a vessel while heating the pitch stream and driving off residual solvent. The residual solvent can be recycled and the discharged heavy pitch stream can be removed and transported as dry pitch. We also envision use of a dryer in a single stage solvent deasphalting unit.

Definitions

As used herein, the term "communication" means that material flow is operatively permitted between enumerated components.

As used herein, the term "downstream communication" means that at least a portion of material flowing to the component in downstream communication may operatively flow from the component with which it communicates.

As used herein, the term "upstream communication" means that at least a portion of the material flowing from the component in upstream communication may operatively flow to the component with which it communicates.

The term "direct communication" means that flow from the upstream component enters the downstream component without passing through a fractionation or conversion unit to undergo a compositional change due to physical fractionation or chemical conversion.

The term "indirect communication" means that flow from the upstream component enters the downstream component after passing through a fractionation and/or conversion unit to undergo a compositional change due to physical fractionation or chemical conversion.

As used herein, the term "a component-rich stream" means that the rich stream coming out of a separator vessel has a greater concentration of the component than the feed to the separator vessel.

As used herein, the term "a component-lean stream" means that the lean stream coming out of a separator vessel has a smaller concentration of the component than the feed to the separator vessel.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the vapor outlet of the column. The bottom temperature is the liquid bottom outlet temperature. Overhead lines and bottoms lines refer to the net lines from the column downstream of any reflux or reboil to the column. Stripper columns may omit a reboiler at a bottom of the column and instead provide heating requirements and separation impetus from a fluidized inert media such as steam. Stripping columns typically feed a top tray and take main product from the bottom.

As used herein, the term "True Boiling Point" (TBP) means a test method for determining the boiling point of a material which corresponds to ASTM D-2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "initial boiling point" (IBP) means the temperature at which the sample begins to boil using ASTM D-7169 or TBP as the case may be.

As used herein, the term "T5", "T70" or "T95" means the temperature at which 5 mass percent, 70 mass percent or 95 mass percent, as the case may be, respectively, of the sample boils using ASTM D-7169 or TBP as the case may be.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator which latter may be operated at higher pressure.

DETAILED DESCRIPTION

Embodiments of the invention relate to the use of SDA to prepare a heavy hydrocarbon feedstock for primary upgrading. According to one embodiment, for example, the heavy hydrocarbon feedstock comprises residual oils such as an atmospheric residuum having an IBP of at least about 232° C. (450° F.), a T5 of about 288° C. (550° F.) and about 392° C. (700° F.), typically no more than about 343° C. (650° F.), and a T95 between about 510° C. (950° F.) and about 700° C. (1292° F.) obtained from the bottoms of an atmospheric crude distillation column. Another heavy hydrocarbon feedstock is vacuum residuum having an IBP of at least 500° C. (932° F.). Tars, bitumen, coal oils, and shale oils may be additional heavy hydrocarbon feed stocks. Bitumen is natural asphalt, tar sands and oil sands, and has been defined as rock containing hydrocarbons more viscous than 10,000 cP or else hydrocarbons that may be extracted from mined or quarried rock. Other natural bitumens are solids, such as gilsonite, grahamite, and ozokerite, which are distinguished by streak, fusibility, and solubility. Other asphaltene-containing materials such as whole or topped petroleum crude oils including heavy crude oils may also be used as components processed by SDA. In addition to asphaltenes, these further possible components of the heavy hydrocarbon feedstock, as well as others, generally also contain significant metallic contaminants, e.g., nickel, iron and vanadium, a high content of organic sulfur and nitrogen compounds, and a high Conradson carbon residue. The metals content of such components, for example, may be 100 ppm to 1,000 ppm by weight, the total sulfur content may range from 1% to 7% by weight, and the API gravity may range from about −5° to about 35°. The Conradson carbon residue of such components is generally at least about 5%, and is often from about 10% to about 30% by weight.

Figure 1:
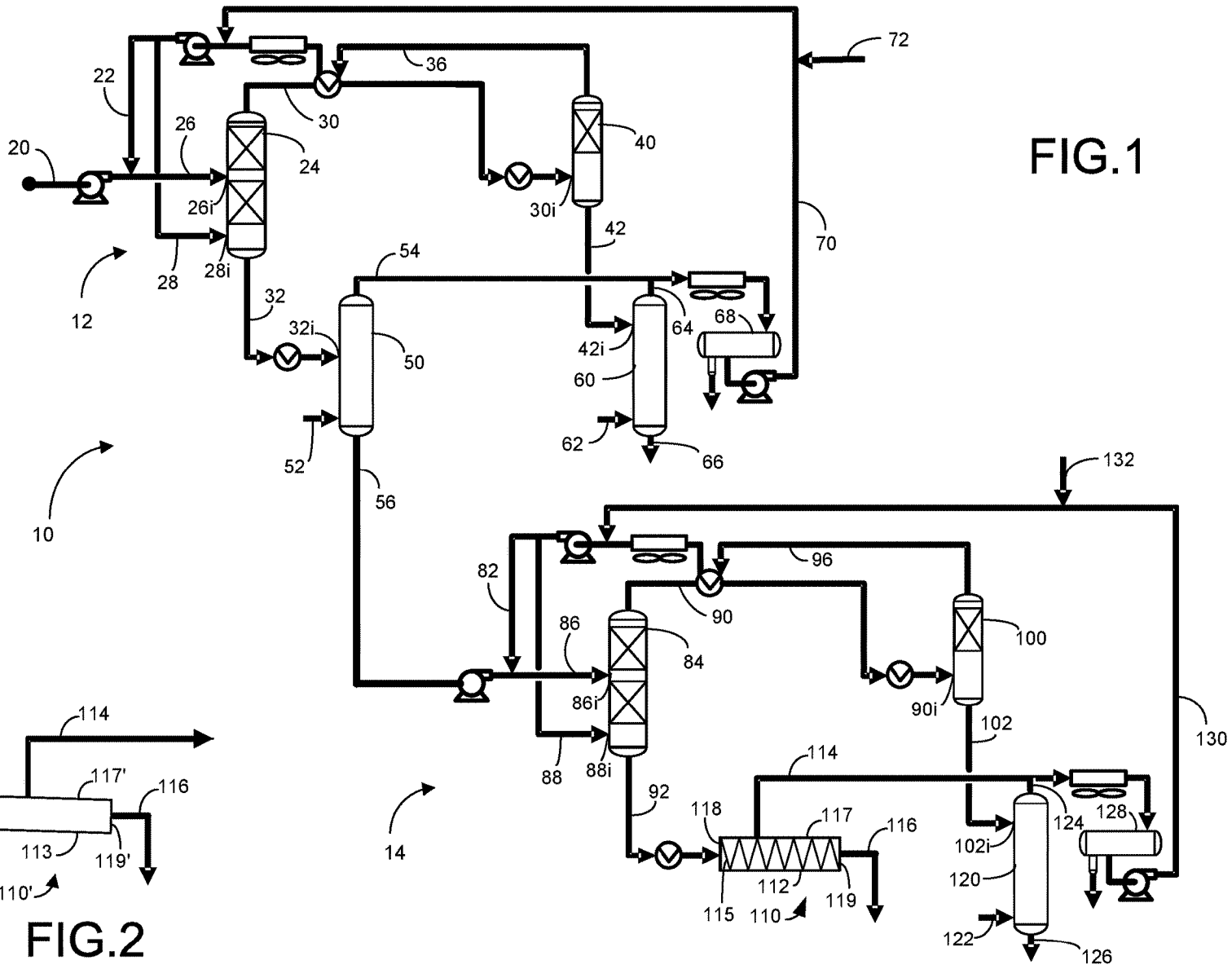
FIG. 1 is a schematic view of a process and apparatus.

As shown in FIG. 1, a process and apparatus 10 for extracting lighter hydrocarbons from heavier hydrocarbons is exemplified by a first solvent deasphalting unit 12 and a second solvent deasphalting unit 14 in series.

A heavy hydrocarbon feed stream in a heavy feed line 20 may be transported to the first solvent deasphalting unit 12. In the SDA process, the heavy hydrocarbon feed stream in the heavy feed line 20 is pumped and admixed with a first mixing solvent stream in a first mixing solvent line 22 before entering into a first extraction column 24. An additional solvent stream, for example, in an additional solvent line 28, may be added to a lower end of the first extraction column 24 through an additional solvent inlet 28*i*. A first extractor inlet line 26 in downstream communication with the heavy feed line 20 and the first mixing solvent line 22 may deliver mixed feed to the first extraction column through the same line to a mixed inlet 26*i*. A first solvent, typically propane or butanes, or mixtures thereof solubilizes the lighter aliphatic hydrocarbon material in the heavy hydrocarbon feed. Trays or packing may be utilized in the first extraction column 24 above each solvent inlet 26*i*, 28*i* to dislodge asphaltic compounds from solubilized deasphalted oil rising in the column. A first DAO stream is extracted from the asphaltenes in the heavy hydrocarbon feed stream and exits the first extraction column 24 in a first DAO line 30 extending from an overhead of the first extraction column 24. The heavier aromatic and polar components of the feed are insoluble in the solvent and precipitate out as a first asphaltene or pitch stream in a first pitch line 32 extending from a bottom of the first extraction column 24. The first extraction column 24 may typically operate at about 70° C. (158° F.) to about 204° C. (400° F.) and about 3.8 MPa (550 psia) to about 5.5 MPa (800 psia).

The first DAO stream in the first DAO line 30 has a greater concentration of aliphatic compounds than in the heavy hydrocarbon feed stream in the heavy feed line 20. The first DAO stream is heated to supercritical temperature for the solvent by indirect heat exchange with a first separated solvent stream in a first separated solvent line 36 in heat exchanger and in a subsequent heater or additional heat exchanger and is fed to the first DAO separator 40 through a first DAO inlet 30*i*. The super critically heated solvent separates from the DAO in a first DAO separator 40 which is in downstream communication with the first DAO line 30 from the overhead of the first extraction column 24. The DAO separator 40 may be a first separator in downstream communication with the first DAO line 30 of the first extraction column 24. A first separated solvent stream exits the DAO separator 40 in the first separator solvent line 36 extending from an overhead of the first DAO separator 40. Packing or trays in the first DAO separator above the first DAO inlet 30*i* may facilitate separation. A first separated DAO stream exits in a first separated DAO line 42 extending from a bottom of the first DAO separator 40. The solvent recycle stream is condensed by indirect heat exchange in a heat exchanger with the first DAO stream in the first DAO line 30 and a condenser. The DAO separator 40 will typically operate at about 177° C. (350° F.) to about 287° C. (550° F.) and about 3.8 MPa (550 psia) to about 5.5 MPa (800 psia).

The first pitch stream in the first pitch line 32 contains a greater concentration of aromatic compounds than in the heavy feed stream in the heavy feed line 20. The first pitch stream in the first pitch line 32 is heated in a heater or by heat exchange and fed to a first pitch stripper 50 through a first pitch inlet 32*i* above an inlet for an inert gas line 52 and in downstream communication with said first pitch line 32 to yield a first solvent recovery stream in a first solvent recovery line 54 extending from an overhead of the first pitch stripper 50 and a first solvent-lean, stripped pitch stream in a first stripped pitch line 56 extending from a bottoms of the first pitch stripper 50. Inert gas such as steam from line 52 distributed below the first pitch inlet 32*i* may be used as stripping fluid in the first pitch stripper 50. The pitch stripper 50 will typically operate at about 204° C. (400° F.) to about 299° C. (570° F.) and about 344 kPa (50 psia) to about 1,034 kPa (150 psia).

A solvent-lean DAO steam exits the DAO separator 40 in the first separated DAO line 42 and enters a first DAO stripper column 60 through a first DAO stripper inlet 42*i* in downstream communication with the first separated DAO line 42. The DAO stripper 60 further separates a first stripper solvent stream in a first stripper solvent line 64 extending from an overhead of said DAO stripper from a first deasphalted stream 66 by stripping solvent from DAO at low pressure with an inert gas from line 62 with an inlet below the first DAO stripper inlet 42*i*. Steam in line 62 may be used as stripping fluid in the DAO stripper 60. The DAO stripper 60 will typically operate at about 149° C. (300° F.) to about 260° C. (500° F.) and about 344 kPa (50 psia) to about 1,034 kPa (150 psia). The first additional solvent recovery stream leaves in the first stripper solvent line 64 and joins the first recovery solvent in the first solvent recovery line 54 before being condensed by a cooler and received in solvent reservoir 68 which may comprise a boot for removing water. Recovered solvent is pumped from the reservoir 68 as necessary through solvent recycle line 70 to supplement the first separated solvent in the first separated solvent line 36 to facilitate extraction in the first extraction column 24. Make-up first solvent may be added at first make-up line 72. Essentially solvent-free DAO is provided in line 66 comprising about 30 to about 50 wt % of the heavy feed in the heavy feed line 20.

The first solvent-lean, stripped pitch stream in the first stripped pitch line 56 comprising the asphaltenes in the first pitch stream in the first pitch line 32 may be transported to the second solvent deasphalting unit 14. In the SDA process and apparatus 10, the first solvent-lean, stripped pitch stream in the first stripped pitch line 56 is pumped and admixed with a second mixing solvent stream in a second mixing solvent line 82 before entering into a second extraction column 84. An additional second solvent stream, for example, in an additional second solvent line 88, may be added to a lower end of the second extraction column 84 through an additional solvent inlet 88*i*. A first extraction inlet line 86 in downstream communication with the first stripped pitch line 56 and the first pitch line 32 and the second mixing solvent line 82 may deliver mixed feed to the second extraction column 84 through the same line to a same mixed inlet 86*i*. A second solvent, typically butane or pentane, or mixtures thereof, that is heavier than the first solvent, solubilizes the aliphatic and lighter hydrocarbon material in the first pitch stream that is heavier than the first pitch stream in the first pitch line 32. Trays or packing may be utilized in the second extraction column above each solvent inlet 86*i*, 88*i* to dislodge asphaltic materials from solubilized deasphalted oil rising in the column. A second DAO stream is extracted from the asphaltenes in the first pitch stream and exits the second extraction column 84 in a second DAO line 90 extending from an overhead of the second extraction column 84. The heavier and aromatic portions of the first pitch stream are insoluble in the heavier solvent and precipitate out as a second asphaltene or pitch stream in a second pitch line 92 extending from a bottom of the second extraction column 84. The second extraction column 84 may typically operate at about 93° C. (200° F.) to about 204° C. (400° F.) and about 3.8 MPa (550 psia) to about 5.5 MPa (800 psia).

The second DAO stream in the second DAO line 90 has a greater concentration of aliphatic compounds than in the first pitch stream in the first stripped pitch line 56. The second DAO stream is heated to supercritical temperature for the second solvent by indirect heat exchange with a second separated solvent stream in a second separated solvent line 96 in a heat exchanger and in a subsequent heater or additional heat exchanger and is fed to the second DAO separator 100 through a second DAO inlet 90*i*. The super critically heated solvent separates from the DAO in the second DAO separator 100 which is in downstream communication with the second DAO line 90 of the second extraction column 84. The second DAO separator 100 may be a first separator in downstream communication with the second DAO line 90 of the second extraction column 84. A second separated solvent stream exits the second DAO separator 100 in the second separator solvent line 96 extending from an overhead of the second DAO separator 100. Packing or trays in the second DAO separator above the second DAO inlet 90*i* may facilitate separation. A second separated DAO stream exits in a second separated DAO line 102 extending from a bottom of the second DAO separator 100. The second separated solvent stream in the second separator solvent line 96 is condensed by indirect heat exchange in the heat exchanger with the second DAO stream in the second DAO line 90 and a condenser. The DAO separator 100 will typically operate at about 177° C. (350° F.) to about 287° C. (550° F.) and about 3.8 MPa (550 psia) to about 5.5 MPa (800 psia).

A second solvent-lean DAO steam exits the second DAO separator 100 in a second separator DAO line 102 and enters a second DAO stripper column 120 through a second DAO stripper inlet 102*i* in downstream communication with the second separated DAO line 102. The second DAO stripper 120 further separates a second stripper solvent stream in a second stripper solvent line 124 extending from an overhead of the DAO stripper from a second deasphalted stream in a second deasphalted line 126 extending from a bottom of the second DAO stripper by stripping solvent from the DAO components at low pressure with an inert gas from line 122 with an inlet below the first DAO stripper inlet 102*i*. Steam in line 102 may be used as stripping fluid in the second DAO stripper column 120. The second DAO stripper column 120 will typically operate at about 149° C. (300° F.) to about 260° C. (500° F.) and about 344 kPa (50 psia) to about 1,034 kPa (150 psia). The second solvent stream leaves in the second stripper solvent line 124 and joins the second recovery solvent stream in a second solvent recovery line 114 before being condensed by a cooler and received in solvent reservoir 128 which may comprise a boot for removing water. Recovered solvent is pumped from the reservoir 128 as necessary through solvent recycle line 130 to supplement the second separated solvent stream in the second separated solvent line 96 to facilitate extraction in the second extraction column 84. Make-up second solvent may be added by a second make up line 132. Essentially, second solvent-free DAO is provided in second deasphalted line 126 comprising about 10 to about 30 wt % of the heavy feed in the heavy feed line 20 giving an aggregate DAO recovery of 40 to about 80 wt % of the heavy feed in the heavy feed line.

The second pitch stream in the second pitch line 92 contains a greater concentration of aromatic compounds than in the first stripped pitch stream in the first stripped pitch line 56, excluding the solvent in the second pitch stream, or than the first pitch stream in the first pitch line 32. However, the second pitch stream comprises the second solvent that must be removed. Stripping the second pitch stream in a pitch stripper as conducted in the first deasphalting unit 12 would produce a second solvent-lean pitch stream that would present difficulty in consistent removal from a second pitch stripper.

Accordingly, the second pitch stream in the second pitch line 92 is preheated in a heater or by heat exchange and then further heated to vaporize and drive off a heated second recovery solvent stream from the second pitch stream in the second solvent recovery line 114. The preheated second pitch stream in the second pitch line 92 may be fed to a dryer 110 which heats the second pitch stream to drive off the solvent by heating it to about 300° C. (572° F.) to about 600° C. (1112° F.).

The dryer 110 can comprise an elongated, horizontal vessel that has a greater width than its height. The dryer 110 may have a general cylindrical configuration and may be tapered toward an end. The dryer 110 comprises an inlet end 118 which receives the second pitch stream. The dryer may have rotating equipment that mechanically moves the second pitch stream from the inlet end 118 to an outlet end 119 under heating. The heated solvent may exit a top of the drier 110 in the second solvent recovery line 114 that may extend from a top of the dryer 110.

The dryer 110 may comprise a rotary kiln, fired kiln, an fired rotary kiln, a fired dryer, an fired rotary dryer, a rotary drum dryer, a fluidized bed dryer, a ring dryer, a paddle dryer, a spray dryer, a flash dryer, a vacuum dryer, and/or a flexi-coker, a kneader-mixer, an extruder, a drum dryer, or other substantially similar equipment. All fired dryers may be directly or indirectly fired. The atmosphere in the dryer 110 is inert, which is preferably an oxygen-free nitrogen atmosphere, but may be any other inert non-oxidizing atmosphere or under vacuum. Drying may occur at a temperature of about 300° C. (572° F.) to about 649° C. (1200° F.) and a pressure of about 4 kPa (0.6 psia) to about 344 kPa (50 psia), which temperature may be maintained for a sufficient residence time to produce a solid pitch product in a second dryer extraction line 116 extending from or communicating with the outlet end 119 and the heated second recovery solvent stream in the second solvent recovery line 114 communicating with or extending from a top of the drier 110. The second solvent stream in the second solvent recovery line 114 joins with second stripper solvent stream in the second stripper solvent line 124, is condensed and fed to the second solvent reservoir 128. Dried solids may be disposed of, used as fuel, further processed for recovery of metals or used as fuel in cement manufacture or as material for asphalt, carbon electrode, carbon black or metallurgical coke manufacturing.

One preferred dryer 110 shown in FIG. 1 comprises an elongated vessel such as a paddle dryer 112 which has a shell 117 and an auger or paddles 115 that are heated such as by circulating hot oil through the shell and hollow paddles, so to heat the second pitch stream to a temperature of about 300° C. (572° F.) to about 400° C. (752° F.). The shell 117 may be cylindrical. The motion of paddles or auger move the second pitch stream from the inlet end 118 to the outlet end and break up clumped solid particles for faster vaporization of the solvent from the pitch.

Figure 2:
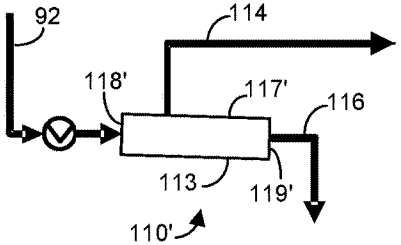
FIG. 2 is a schematic view of an alternative drier for the process and apparatus of FIG. 1.

FIG. 2 shows an embodiment of another preferred dryer 110'. Elements in FIG. 2 with the same configuration as in FIG. 1 will have the same reference numeral as in FIG. 1. Elements in FIG. 2 which have a different configuration as the corresponding element in FIG. 1 will have the same reference numeral but designated with a prime symbol (').

The configuration and operation of the embodiment of FIG. 2 is essentially the same as in FIG. 1.

The other preferred dryer 110' comprises an elongated, horizontal vessel such as a rotary kiln 113 which has a shell 117' but typically no paddles. The shell 117' may be cylindrical and optionally tapered. In the rotary kiln 113, the second pitch stream is heated to about 500 to about 600° C. The shell 117' is slightly inclined downwardly from the inlet end 118' to the outlet end 119'. Circumferential rotation of the shell 117' and gravity operate to move the second pitch stream from the inlet end 118' to the outlet end 119' enabling exposure of surfaces in the asphaltic material for faster vaporization of the solvent from the pitch. Inner surface of the rotary kiln may include baffles that propel material toward the outlet end 119'. Use of a rotary kiln 113 may operate to crack asphaltenes to lighter hydrocarbons such as lighter gases, naphtha, diesel and gas oil which may go up in the second solvent recovery line 114 and require further separation of solvent from cracked hydrocarbons before the solvent can be recycled to the second solvent reservoir 128 in FIG. 1. Petroleum coke may be obtained from second dryer extraction line 116.

It is also envisioned that the drier 110 can be used in place of the pitch stripper 50 in a single stage solvent deasphalting unit 12.

Specific Embodiments

While the following is described in conjunction with specific embodiments, it will be understood that this description is intended to illustrate and not limit the scope of the preceding description and the appended claims.

A first embodiment of the invention is a process for extracting lighter hydrocarbons from heavier hydrocarbons comprising deasphalting a heavy hydrocarbon feed stream with a solvent to extract a deasphalted oil stream containing a greater concentration of aliphatic compounds than in the feed stream and provide a pitch stream containing a greater concentration of aromatic compounds than in the feed stream; and heating the pitch stream in a horizontally elongated vessel to drive off a heated solvent stream from the pitch stream. An embodiment of the invention is one, any or all of prior embodiments in this paragraph up through the first embodiment in this paragraph, wherein the heavy hydrocarbon feed stream is a first pitch stream, the solvent is a second solvent, the deasphalted oil stream is a second deasphalted oil stream and the pitch stream is a second pitch stream and further comprising deasphalting a first heavy hydrocarbon stream with a first solvent to extract a first deasphalted oil stream containing a greater concentration of aliphatic compounds than in the first heavy hydrocarbon stream and provide the first pitch stream containing a greater concentration of aromatic compounds than in the first heavy hydrocarbon stream. An embodiment of the invention is one, any or all of prior embodiments in this paragraph up through the first embodiment in this paragraph further comprising stripping the first pitch stream to separate a first solvent recovery stream from the first pitch stream before the first pitch stream is deasphalted with a second solvent. An embodiment of the invention is one, any or all of prior embodiments in this paragraph up through the first embodiment in this paragraph wherein the heating step is conducted in a dryer in which the second pitch stream is moved from an inlet end to an outlet end as it is heated. An embodiment of the invention is one, any or all of prior embodiments in this paragraph up through the first embodiment in this paragraph wherein the elongated vessel is a paddle dryer or a rotary kiln. An embodiment of the invention is one, any or all of prior embodiments in this paragraph up through the first embodiment in this paragraph, further comprising separating the second deasphalted oil stream into a second separated solvent stream and a second separated deasphalted stream. An embodiment of the invention is one, any or all of prior embodiments in this paragraph up through the first embodiment in this paragraph, further comprising stripping the second separated deasphalted stream to provide a second stripper solvent stream and a second deasphalted stream. An embodiment of the invention is one, any or all of prior embodiments in this paragraph up through the first embodiment in this paragraph, further comprising recycling the heated second solvent stream, the second separated solvent stream and the second stripper solvent stream to the second deasphalting step. An embodiment of the invention is one, any or all of prior embodiments in this paragraph up through the first embodiment in this paragraph, further comprising separating the first deasphalted oil stream into a first separated solvent stream and a first separated deasphalted stream; and stripping the first separated deasphalted stream to provide a first stripper solvent stream and a first deasphalted stream. An embodiment of the invention is one, any or all of prior embodiments in this paragraph up through the first embodiment in this paragraph, further comprising recycling the first solvent recovery stream, the first stripper solvent stream, and the first separated solvent stream to the first deasphalting step.

A second embodiment of the invention is an apparatus for solvent deasphalting comprising a first extraction column having a first heavy feed inlet and a first solvent inlet, a first deasphalted oil line extending from an overhead of the first extraction column and a first extraction line extending from a bottom of the first extraction column; a second extraction column having a second solvent inlet and a first asphalted feed inlet in downstream communication with a first pitch line and a second deasphalted oil line extending from an overhead of the second extraction column and a second extraction line extending from a bottom of the second extraction column; a dryer in downstream communication with a second pitch line at an inlet end and having a solids outlet at an opposite end and a heated solvent outlet extending from a top of the device. An embodiment of the invention is one, any or all of prior embodiments in this paragraph up through the second embodiment in this paragraph further comprising a first pitch stripper column comprising a first asphaltene inlet above an inert gas inlet and in downstream communication with the first extraction line, and a first solvent recovery line extending from an overhead of the first pitch stripper and a first pitch stripper line extending from a bottom of the pitch stripper. An embodiment of the invention is one, any or all of prior embodiments in this paragraph up through the second embodiment in this paragraph wherein the second solvent inlet is in downstream communication with the heated solvent outlet. An embodiment of the invention is one, any or all of prior embodiments in this paragraph up through the second embodiment in this paragraph further including a second deasphalted oil separator having a second separator solvent line extending from an overhead of the second deasphalted oil separator and a second separator DAO line extending from a bottom of the second deasphalted oil separator and a second deasphalted oil stripper column having a second deasphalted oil stripper inlet above an inert gas inlet and in downstream communication with the second separator DAO line and the second deasphalted oil stripper column having a second stripper solvent line extending from an overhead of the second deasphalted oil striper column and a second deasphalted stream extending from a bottom of the second deasphalted oil stripper column. An embodiment of the invention is one, any or all of prior embodiments in this paragraph up through the second embodiment in this paragraph, wherein the second solvent inlet is in downstream communication with the second separator solvent line and the second stripper solvent line. An embodiment of the invention is one, any or all of prior embodiments in this paragraph up through the second embodiment in this paragraph wherein the dryer is a paddle dryer or a rotary kiln.

A third embodiment of the invention is a process for extracting lighter hydrocarbons from heavier hydrocarbons comprising deasphalting a heavy hydrocarbon feed stream with a first solvent to extract a first deasphalted oil stream containing a greater concentration of aliphatic compounds than in the feed stream and provide a first pitch stream containing a greater concentration of aromatic compounds than in the feed stream; stripping the first pitch stream with an inert gas to separate a first solvent recovery stream from the first pitch stream to provide a first solvent-lean pitch stream; deasphalting the first solvent-lean pitch stream with a second solvent to extract a second deasphalted oil stream containing a greater concentration of aliphatic compounds than in the first solvent-lean pitch stream and provide a second pitch stream containing a greater concentration of aromatic compounds than in the stripped first pitch stream; and heating the second pitch stream to drive off a heated second solvent stream from the second asphaltene product. An embodiment of the invention is one, any or all of prior embodiments in this paragraph up through the third embodiment in this paragraph wherein the heating step is conducted in an elongated vessel and moving the second pitch stream from an inlet end to an outlet end as it is heated. An embodiment of the invention is one, any or all of prior embodiments in this paragraph up through the third embodiment in this paragraph, further comprising separating the second deasphalted oil stream into a second separated solvent stream and a second separated deasphalted oil stream and stripping the second separated deasphalted oil stream to provide a second stripper solvent stream and a second deasphalted stream. An embodiment of the invention is one, any or all of prior embodiments in this paragraph up through the third embodiment in this paragraph, further comprising recycling the heated second solvent stream, the second separated solvent stream and the second stripper solvent stream to the second deasphalting step.

A fourth embodiment of the invention is a process for extracting lighter hydrocarbons from heavier hydrocarbons comprising deasphalting a heavy hydrocarbon feed stream with a first solvent to extract a first deasphalted oil stream containing a greater concentration of aliphatic compounds than in the feed stream and provide a first asphaltene stream containing a greater concentration of aromatic compounds than in the feed stream; deasphalting the first asphaltene stream with a second solvent to extract a second deasphalted oil stream containing a greater concentration of aliphatic compounds than in the first asphaltene stream and provide a second asphaltene stream containing a greater concentration of aromatic compounds than in the first asphaltene stream; and heating the second asphaltene stream to drive off a heated second solvent stream from the second asphaltene stream. An embodiment of the invention is one, any or all of prior embodiments in this paragraph up through the fourth embodiment in this paragraph further comprising stripping the first asphaltene stream to separate a first solvent recovery stream from the first asphaltene stream before the first asphaltene stream is deasphalted with a second solvent. An embodiment of the invention is one, any or all of prior embodiments in this paragraph up through the fourth embodiment in this paragraph wherein the heating step is conducted in a drier in which the second asphaltene stream is moved from an inlet end to an outlet end as it is heated. An embodiment of the invention is one, any or all of prior embodiments in this paragraph up through the fourth embodiment in this paragraph wherein the elongated vessel is a paddle drier or a rotary kiln. An embodiment of the invention is one, any or all of prior embodiments in this paragraph up through the fourth embodiment in this paragraph, further comprising recycling the second solvent to the second deasphalting step. An embodiment of the invention is one, any or all of prior embodiments in this paragraph up through the fourth embodiment in this paragraph, further comprising separating the second deasphalted oil stream into a second separated solvent stream and a second separated deasphalted stream. An embodiment of the invention is one, any or all of prior embodiments in this paragraph up through the fourth embodiment in this paragraph, further comprising stripping the second separated deasphalted stream to provide a second stripper solvent stream and a second deasphalted stream. An embodiment of the invention is one, any or all of prior embodiments in this paragraph up through the fourth embodiment in this paragraph, further comprising recycling the heated second solvent stream, the second separated solvent stream and the second stripper solvent stream to the second deasphalting step. An embodiment of the invention is one, any or all of prior embodiments in this paragraph up through the fourth embodiment in this paragraph, further comprising separating the first deasphalted oil stream into a first separated solvent stream and a first separated deasphalted stream; and stripping the first separated deasphalted stream to provide a first stripper solvent stream and a first deasphalted stream. An embodiment of the invention is one, any or all of prior embodiments in this paragraph up through the fourth embodiment in this paragraph, further comprising recycling the first solvent recovery stream, the first stripper solvent stream, and the first separated solvent stream to the first deasphalting step.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for extracting lighter hydrocarbons from heavier hydrocarbons comprising:

deasphalting a heavy hydrocarbon feed stream with a solvent to extract a deasphalted oil stream containing a greater concentration of aliphatic compounds than in the feed stream and provide a pitch stream containing a greater concentration of aromatic compounds than in the feed stream; and heating the pitch stream in a horizontally elongated vessel to drive off a heated solvent stream from the pitch stream, said elongated vessel is a paddle dryer or a rotary kiln.

2. The process of claim 1 wherein said heavy hydrocarbon feed stream is a first pitch stream, said solvent is a second solvent, said deasphalted oil stream is a second deasphalted oil stream and said pitch stream is a second pitch stream and further comprising:

deasphalting a first heavy hydrocarbon stream with a first solvent to extract a first deasphalted oil stream containing a greater concentration of aliphatic compounds than in the first heavy hydrocarbon stream and provide said first pitch stream containing a greater concentration of aromatic compounds than in the first heavy hydrocarbon stream.

3. The process of claim 2 further comprising stripping said first pitch stream to separate a first solvent recovery stream from said first pitch stream before the first pitch stream is deasphalted with a second solvent.

4. The process of claim 2 wherein said heating step is conducted in a dryer in which the second pitch stream is moved from an inlet end to an outlet end as it is heated.

5. The process of claim 2 further comprising separating said second deasphalted oil stream into a second separated solvent stream and a second separated deasphalted stream.

6. The process of claim 5 further comprising stripping said second separated deasphalted stream to provide a second stripper solvent stream and a second deasphalted stream.

7. The process of claim 6 further comprising recycling the heated second solvent stream, the second separated solvent stream and the second stripper solvent stream to said second deasphalting step.

8. The process of claim 3 further comprising separating said first deasphalted oil stream into a first separated solvent stream and a first separated deasphalted stream; and stripping said first separated deasphalted stream to provide a first stripper solvent stream and a first deasphalted stream.

9. The process of claim 8 further comprising recycling the first solvent recovery stream, the first stripper solvent stream, and the first separated solvent stream to said first deasphalting step.

10. An apparatus for solvent deasphalting comprising:

a first extraction column having a first heavy feed inlet and a first solvent inlet, a first deasphalted oil line extending from an overhead of the first extraction column and a first extraction line extending from a bottom of said first extraction column;

a second extraction column having a second solvent inlet and a first asphalted feed inlet in downstream communication with a first pitch line and a second deasphalted oil line extending from an overhead of the second extraction column and a second extraction line extending from a bottom of the second extraction column; and a dryer in downstream communication with a second pitch line at an inlet end and having a solids outlet at an opposite end and a heated solvent outlet extending from a top of the dryer.

11. The apparatus of claim 10 further comprising a first pitch stripper column comprising a first pitch inlet above an inert gas inlet and in downstream communication with said first extraction line, and a first solvent recovery line extending from an overhead of said first pitch stripper and a first pitch stripper line extending from a bottom of the pitch stripper.

12. The apparatus of claim 10 wherein said second solvent inlet is in downstream communication with said heated solvent outlet.

13. The apparatus of claim 12 further including a deasphalted oil separator having a second separator solvent line extending from an overhead of said deasphalted oil separator and a second separator DAO line extending from a bottom of said deasphalted oil separator and a second deasphalted oil stripper column having a second deasphalted oil stripper inlet above an inert gas inlet and in downstream communication with the second separator DAO line and said second deasphalted oil stripper column having a second stripper solvent line extending from an overhead of said second deasphalted oil striper column and a second deasphalted stream extending from a bottom of the second deasphalted oil stripper column.

14. The apparatus of claim 13 wherein said second solvent inlet is in downstream communication with said second separator solvent line and said second stripper solvent line.

15. The apparatus of claim 10 wherein said the dryer is a paddle dryer or a rotary kiln.

16. A process for extracting lighter hydrocarbons from heavier hydrocarbons comprising:

deasphalting a heavy hydrocarbon feed stream with a first solvent to extract a first deasphalted oil stream containing a greater concentration of aliphatic compounds than in the feed stream and provide a first pitch stream containing a greater concentration of aromatic compounds than in the feed stream;

stripping said first pitch stream with an inert gas to separate a first solvent recovery stream from said first pitch stream to provide a first solvent-lean pitch stream;

deasphalting said first solvent-lean pitch stream with a second solvent to extract a second deasphalted oil stream containing a greater concentration of aliphatic compounds than in the first solvent-lean pitch stream and provide a second pitch stream containing a greater concentration of aromatic compounds than in the stripped first pitch stream;

heating the second pitch stream to drive off a heated second solvent stream from the second pitch product; and separating said second deasphalted oil stream into a second separated solvent stream and a second separated deasphalted oil stream.

17. The process of claim 16 wherein said heating step is conducted in an elongated vessel and moving the second pitch stream from an inlet end to an outlet end as it is heated.

18. The process of claim 16 further comprising stripping said second separated deasphalted oil stream to provide a second stripper solvent stream and a second deasphalted stream.

19. The process of claim 18 further comprising recycling the heated second solvent stream, the second separated solvent stream and the second stripper solvent stream to said second deasphalting step.

* * * * *